US006849031B2

(12) United States Patent
Paci

(10) Patent No.: US 6,849,031 B2
(45) Date of Patent: Feb. 1, 2005

(54) ARTIFICIAL WATERFALL CLIMBING STRUCTURE

(76) Inventor: Laercio Paci, 5091 Ernst Ct., Orlando, FL (US) 32819

( * ) Notice: Subject to any disclaimer, the term of this patent is extended or adjusted under 35 U.S.C. 154(b) by 0 days.

(21) Appl. No.: 10/162,618

(22) Filed: Jun. 6, 2002

(65) Prior Publication Data

US 2003/0228956 A1 Dec. 11, 2003

(51) Int. Cl.[7] ..... A63B 9/00

(52) U.S. Cl. ..... 482/37; 482/35; D21/826; D21/827

(58) Field of Search ..... 482/7, 35, 37, 482/52, 54; D21/826, 819, 820, 827; 428/15, 27

(56) References Cited

U.S. PATENT DOCUMENTS

| | | | | | |
|---|---|---|---|---|---|
| 4,747,538 | A | * | 5/1988 | Dunn et al. | 239/20 |
| 4,750,733 | A | * | 6/1988 | Foth | 472/117 |
| 4,754,571 | A | * | 7/1988 | Riechmann | 47/59 R |
| 5,092,587 | A | | 3/1992 | Ulner | |
| 5,125,877 | A | | 6/1992 | Brewer | |
| 5,194,048 | A | * | 3/1993 | Briggs | 472/128 |
| 5,234,728 | A | * | 8/1993 | Chiang | 428/13 |
| 5,543,185 | A | | 8/1996 | Christensen | |
| 5,637,361 | A | * | 6/1997 | Scheurich | 428/13 |
| 5,775,260 | A | * | 7/1998 | Jansen | 119/246 |
| 6,083,142 | A | | 7/2000 | Wilson | |
| 6,527,257 | B1 | * | 3/2003 | Schuld | 261/29 |
| 2002/0046903 | A1 | | 4/2002 | Strickler | |

* cited by examiner

*Primary Examiner*—Nicholas D. Lucchesi
*Assistant Examiner*—Tam Nguyen

(57) ABSTRACT

The invention provides a unique interactive waterfall-climbing structure. The invention provides a tower, based on the use of polystyrene foam, cut into various shapes to create a series of descending depressions and ledges to simulate a waterfall. The foam mold is covered with fiberglass to form a rigid, solid single panel. A steel frame is then attached to the one-piece fiberglass shell, allowing the structure to stand self-supported. The invention also provides a waterfall system including a dispensing tank at the top to allow water to overflow outward and cascade down the climbing surface and a reservoir tank to collect the water. The invention further provides a pump for re-circulating the water and a conduit to direct water from the reservoir upwardly to the dispensing tank.

17 Claims, 3 Drawing Sheets

ARTIFICIAL WATERFALL CLIMBING STRUCTURE

BACKGROUND OF THE INVENTION

The present invention relates to recreational waterfall climbing activities. Waterfall climbing is a popular and adventurous sport that is fun, challenging, and provides an immediate "rush" for thrill seekers. However, there is also much controversy over the safety of the sport, due to the fact that waterfall rocks are unstable and unpredictable, and it is difficult for many people to locate adequate waterfalls for climbing purposes.

Nonetheless, sports enthusiasts are interested and still participate in the sport because it is relatively new and provides a greater adrenaline rush than other recreational risk activities. Many beginners and amateurs are also interested in waterfall climbing, but are intimidated by the dangers and risks involved. These people seek out alternative, safer ways to climb by means of artificial rock climbing structures. Although climbing structures were originally designed to aid experienced rock climbers in training and practice, they have developed into a new area, used by many for the sole purpose of fun and excitement. The structures can be seen today at amusement parks, fairs and carnivals, causing a vast increase in the number of climbers of artificial climbing structures. Typical artificial climbing structures are based on dry rock climbing, where climbers never encounter water. Initially, climbing structures were generally constructed of plywood panels, however recent advancements in artificial climbing structures have given rise to more realistic climbing surfaces. The plywood panels have been replaced with the fiberglass mixture that is popular today, as fiberglass is strong, durable, and weather resistant. Fiberglass can be sprayed or laid over a mold and then pulled off to create panels that are attached to a frame to create the climbing structure.

Although these structures have been fairly successful, they have certain limitations that limit their usefulness. Experienced climbers eventually master structures that are used for training and practice, as these structures do not change. While it is possible to alter the climbing surface of a climbing structure by placing a hose at the top of the structure and allowing water to run down to simulate a waterfall, the costs more than outweigh the benefits.

Most artificial rock climbing structures are not equipped or prepared for the effects of water continuously cascading down the climbing surface. Water would not be recirculated and would soak into the ground or a drain, which can be expensive, damaging to the surrounding area, and environmentally harmful. Further, water from a hose is generally not treated and will cause mold of mildew to accumulate on the climbing surface of the structure, making the surface slippery and possibly dangerous. Additionally, in an aesthetic aspect, the climbing surface will be unattractive due to the mold and mildew.

In light of the above, it would be desirable to provide an artificial recreational waterfall climbing structure that allows for the training and practice of experienced climbers, while further allowing for the enjoyment and thrill of climbers who simply climb for fun and excitement. It is possible for these waterfall climbing structures to be fixed or mobile, to allow for easy set-up in amusement parks, water parks, fairs, sporting or other events that appeal to sport and climbing enthusiasts. It would particularly be desirable to provide artificial waterfall climbing structures that collect and re-circulate water, to significantly reduce the cost and waste of a continuous flow of water. It would further be desirable to provide a valve to regulate the water flow in order to alter the difficulty and challenge of the climbing surface.

The structures provide a way to sample the sport of waterfall climbing without the danger involved. They also provide a testing ground for climbing equipment such as harnesses and boots that are necessary for actual waterfall climbing while providing safety and comfort.

SUMMARY OF THE INVENTION

The present invention provides a unique artificial waterfall climbing structure. In a first aspect, the invention provides a tower. The structure is based on the use of polystyrene foam. The foam is cut into various shapes that simulate a rock formation representing a series of descending depressions and ledges to create a waterfall. The shaped polystyrene foam mold is covered with fiberglass to form a rigid, solid single panel. A steel frame is then attached to the one-piece fiberglass shell. The structure is substantially self-supporting and can be used in mobile or fixed installations.

The present invention also provides a waterfall system with a reservoir tank located at the base of the climbing structure for collecting water. At the top of the climbing structure is a dispensing tank including an upwardly open ledge member with a contoured undulating upper surface for directing water in a generally parallel manner from said dispensing tank. A pump means is attached to the steel support frame for re-circulating the water. A conduit means operates with the pump and directs the flow of water from the first end (reservoir tank) to the second end (dispensing tank) whereupon the water overflows and cascades outward to be collected in the reservoir tank. After flowing down the outer surface of the climbing structure and into the reservoir tank the water is directed into the conduit for continual pumping of the water between the first end and the second end. In another aspect, the present invention provides an artificial waterfall climbing structure, with a plurality of climbing holds distributed across the climbing area. The holds are textured to provide a non-slip surface for safety purposes as the water cascades down the climbing structure. The holds define a plurality of climbing routes on the laterally curved panel of the waterfall-climbing surface. Three or more climbers can be accommodated and climb simultaneously on the curved panel.

DETAILED DESCRIPTION OF THE INVENTION

Figure 1:
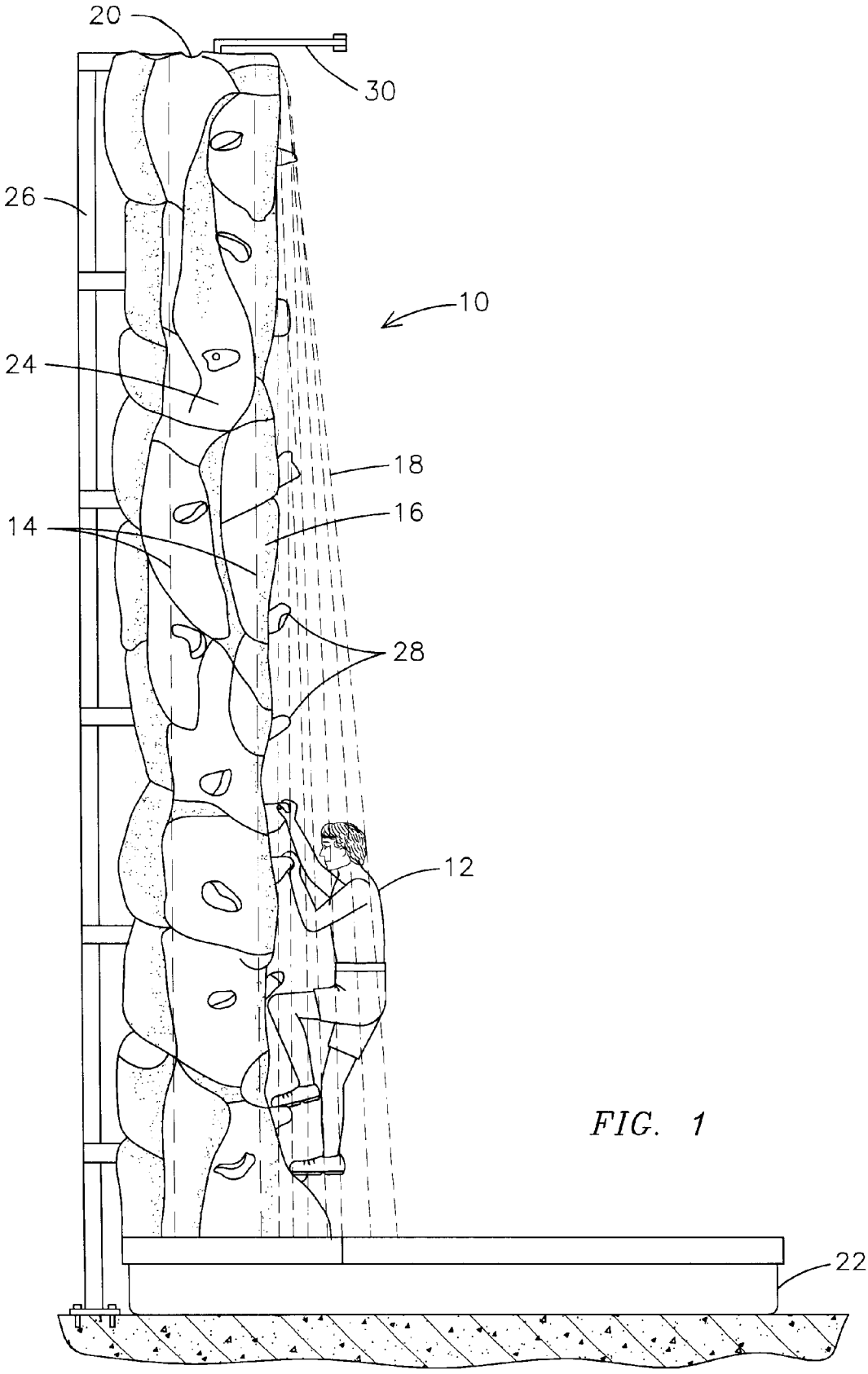
FIG. 1 illustrates a waterfall climbing structure according to the principles of the present invention, in which the tower is in a vertical orientation for operation.

FIG. 1 illustrates a waterfall climbing system 10 in which a climber 12 ascends a route 14 on a climbing surface 16.

The climber encounters water 18 during the climb as it flows outwardly from dispensing tank 20 and cascades down the climbing surface to be collected in reservoir tank 22.

Waterfall climbing system 10 is generally assembled by affixing single laterally curved panel 24 to steel support frame 26. The panel generally curves laterally about an axis so as to define an arc angle of about 180 degrees. Hence, the climbing surface of the panel is substantially cylindrical. The frame is affixed around the peripheral edge of climbing surface 16. This single panel and steel support frame will allow the structure to be substantially self-supported to allow for ease of mobility and trailering.

Commercially available climbing holds 28 are distributed across the climbing surface to define at lease three axial routes, with the routes sufficiently separated circumferentially along the lateral curve of the structure so that three climbers can climb simultaneously. The single panel includes a plurality of nuts that are imbedded within the fiberglass to allow a bolt to be passed through each climbing hold, anchoring the hold to the climbing surface of the panel.

The manufacturing process begins with the use of a large block of polystyrene foam. The climbing structure and dispensing tank are formed from a mold based on the use of the foam block cut into various shapes to create a series of descending depressions and ledges to simulate a waterfall.

The top of the foam block is first hollowed out in order to create the dispensing tank. The dispensing tank will generally be large enough to accommodate 100 gallons of water at a given time. Carving the outwardly oriented portion of the remainder of the foam block to define three different climbing routes then creates the climbing surface. Generally the foam will be shaped to curve in such a way whereas there is a definite front climbing route and one climbing route on each side of the climbing surface.

Generally the foam is carved into rock-like shapes while a temporary water source provides water to fill the hollowed out area of the dispensing tank, allowing the water to overflow and cascade down the foam block during the carving process. This is particularly advantageous as it allows for immediate observation of the waterfall effect in order to make necessary changes to the climbing structure. The depressions and ledges are carved to vary in size and shape to allow for different levels of difficulty on each route during a climb.

When the foam mold is completed, it is covered with fiberglass. The fiberglass is first mixed with coloring to simulate the color of actual waterfall rocks. In the areas where water will flow down the rocks, a separate color mixture of fiberglass may be used to give the appearance of worn or weathered rocks, further enhancing the realistic effect of the climbing surface. The fiberglass is then laid on the foam mold to cover the entire surface including the hollowed out area of the dispensing tank, and a hardening chemical is sprayed or brushed over the laid fiberglass. After the fiberglass hardens, it is removed from the foam mold to form a single panel.

Figure 2:
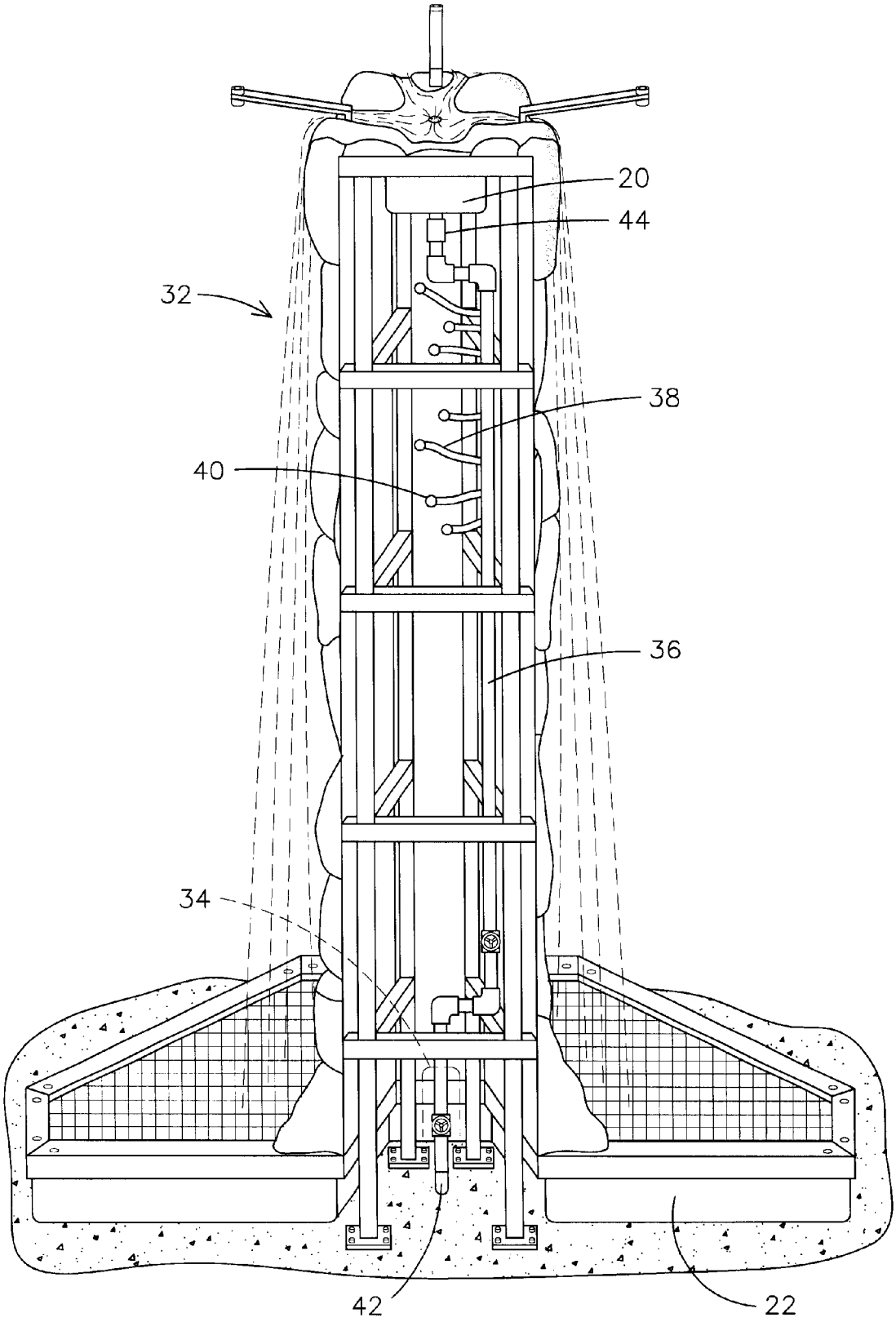
FIG. 2 is a back view of the waterfall climbing structure of FIG. 1, showing the waterfall system having a reservoir tank, a dispensing tank, a pump and a conduit for water circulation.

The panel is then attached to a steel frame that is affixed around the peripheral edge of the climbing surface. The steel frame includes davits 30 that allow the attachment of commercially available auto-belay devices, which aid the climber in the ascent and descent of the climbing structure. Attachment of the frame is facilitated by including nuts embedded on the peripheral edge of the panel, so that a bolt can be passed through the frame and the nut, to permanently affix the frame to the panel. This allows the waterfall climbing structure to be substantially self-supported in fixed or mobile installations. FIG. 2 illustrates waterfall system 32 located inside the waterfall climbing structure. Waterfall system includes dispensing tank 20, reservoir tank 22, pump 34 and conduit 36. The waterfall system further includes a misting system with a plurality of tubes 38 and nozzles 40.

The dispensing tank (as shown in FIGS. 1 and 2) is located at the top of the climbing structure and allows water to overflow outwardly and down the climbing surface to simulate a waterfall. The water flows parallel to climbing surface and is collected in the reservoir tank.

The reservoir tank is located at the base of the climbing structure and is constructed from a wood mold. Fiberglass is laid over the entire surface of the wood mold and a hardening liquid is sprayed or brushed over the surface of the fiberglass. After hardening, the fiberglass reservoir tank is removed from the wood mold. Fiberglass is the preferred material as it will not oxidize or corrode when in contact with water for extended periods of time.

Pump 34 is partially submerged in the reservoir tank. The pump forces water in a generally upward direction to the dispensing tank by way of conduit 36. The conduit contains flexible first end 42 with a suction side to draw water from reservoir and second end 44 with a discharge side to expel water into the dispensing tank.

The misting system as shown in FIG. 2 works simultaneously with the waterfall system. One end of each misting tube 38 is affixed near the second end of the conduit to draw water through the tube to eliminate need for a separate pump to operate the misting system. A hole is drilled through the climbing surface of the climbing structure to allow the other end of each misting tube to come through the outwardly oriented side of the climbing surface. Nozzles 40 are affixed to the end of the outwardly oriented misting tube to render water into mist. In addition to the cascading water from the waterfall system, the mist creates a fog-like effect down the outer surface of the climbing structure, further enhancing the realistic effect of an actual waterfall.

Figure 3:
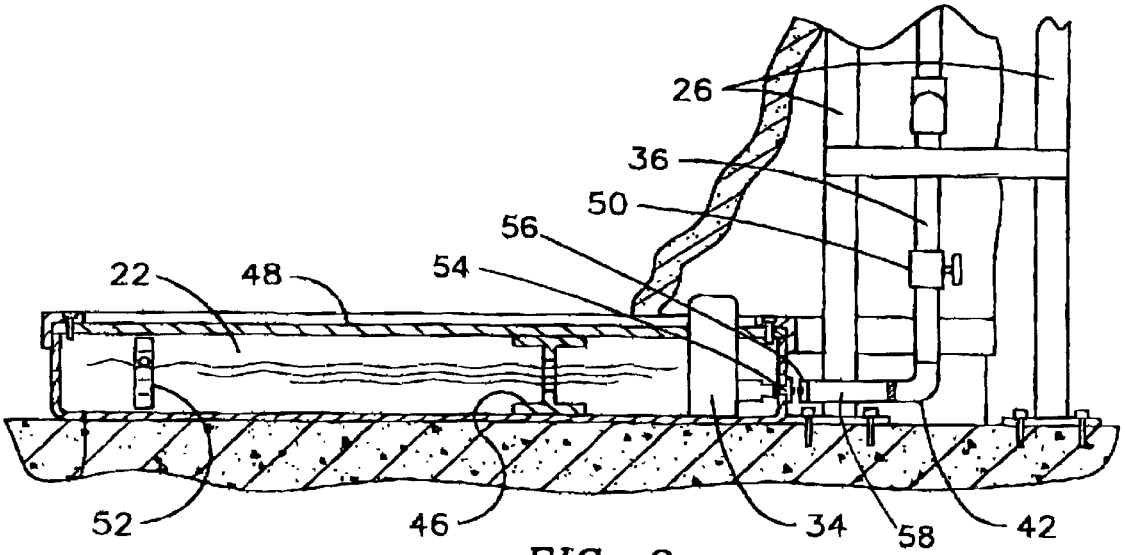
FIG. 3 is a side exploded view of the waterfall climbing structure of FIG. 1, showing the reservoir, pump, conduit, water regulator valve, I-beam, and low water level indicator.

FIG. 3 illustrates reservoir tank 22, which is positioned under the climbing structure and against steel support frame 26 at the time of vertical orientation to collect and re-circulate water (as can be seen in FIGS. 1 and 2). The reservoir tank provides a total overall diameter that is sufficiently large enough to collect a substantial amount of water to allow for adequate continual recycling by the pump and conduit without need for an alternate outside water source.

As can be understood with reference to FIG. 3, a small hole is drilled in the reservoir tank near its base to affix a hose attachment 54 with a quick-connect coupling 56. At the time of assembly or setup of the climbing structure, the reservoir is positioned under the climbing structure whereas the flexible first end of the conduit 58 is affixed to the hose attachment 54, thereby connecting both ends of the conduit, allowing water from the reservoir to be drawn in and pumped upwardly to the second end of the conduit to the dispensing tank. In addiction to collecting and re-circulating water, the reservoir tank helps stabilize the climbing structure while in the vertical orientation. The reservoir tank contains enough water at a given point in time to help the structure withstand high winds and other elements by keeping the structure secured in place by the weight of the water in the reservoir.

As can also be understood with reference to FIG. 3, reservoir tank 22 contains perforated I-beam 46 that is located within the reservoir tank running directly across the center of the tank. The I-beam acts as a support for platform grating 48.

The waterfall system further includes water control valve 50 located on first end 42 of conduit 36 in reservoir tank 22. The water control valve is useful in regulating the flow of the water from pump 34 to the dispensing tank. Water flow from the dispensing tank is increased or decreased to allow the waterfall to match a desired aesthetic effect and/or alter the level of difficulty of the climbing surface.

The waterfall system further includes a low water level indicator 52 located in reservoir tank 22 and a means of controlling pump damage due to lower water levels in said reservoir (as can be understood with reference to FIG. 3). The reservoir tank contains a small clear enclosure that permanently holds a buoyant marker. The enclosure displays a vertical measuring gauge such as the amount of gallons of water held in the reservoir. The buoyant marker floats atop the water and can be seen through the enclosure. Water level is determined by viewing the buoyant marker in relation to the measuring gauge. If the buoyant marker falls below minimum required water level as depicted by measuring gauge, water must be added to reservoir. The low water level indicator eliminates the need to remove grating 48 in order to physically check the level of water in the reservoir. The indicator also reduces the probability of damage to the pump and conduit by clearly defining the required level of water necessary for optimal operation of the structure.

Figure 4:
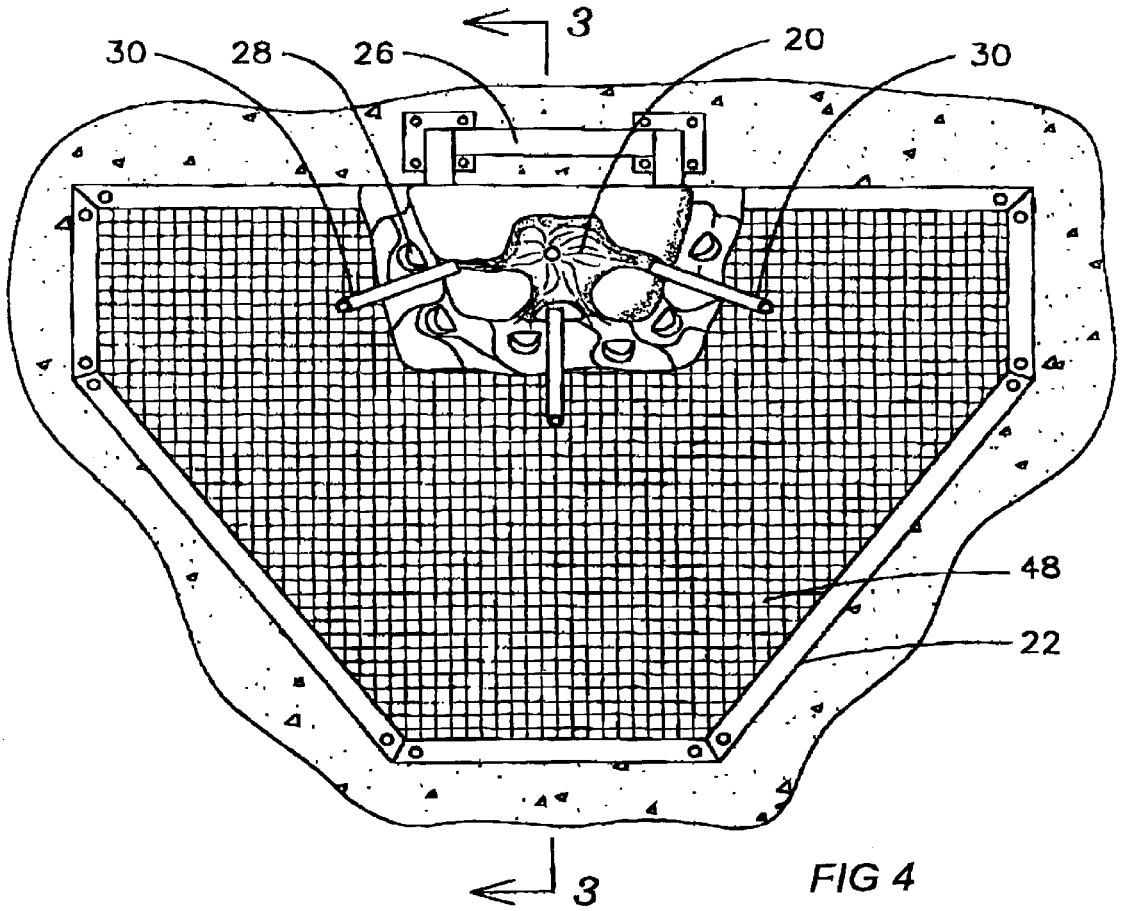
FIG. 4 is a top view of the waterfall climbing structure of FIG. 1, showing the lateral curve of the single panel, the davits, steel frame and grating.

FIG. 4 illustrates reservoir tank 22 positioned under the climbing structure and against steel frame 26 in the vertical orientation. Climbing holds 28 are shown along the top of the climbing structure to further illustrate the method of climbing. Davits 30 allow commercially available auto-belay devices to be attached in order for the climber to safely ascend and descend the structure. Grating 48 allows the climbers to step onto the reservoir tank in order to climb the structure without the need to step directly into the tank and come in contact with the water inside the reservoir. The grating is constructed of an industrial-strength fiberglass material that is chemical resistant and highly durable. The 5,000 lb. per square inch strength of the grating allows the safe accommodation of climbers while further allowing simultaneous collection of water from dispensing tank 20.

As will be obvious to those of skill in the art, the present invention may include embodiments in other specific forms. For example, the polystyrene foam could be carved to simulate different types of climbing surfaces without departing from the essential characteristics of the waterfall climbing structure. Alternately, different color mixtures can be used to further enhance the realistic effect of the structure. The disclosure of the detailed description of the drawings of the invention is intended to be illustrative, but not limiting, of the scope of the invention which is set forth in the following claims.

What is claimed is:

1. An artificial waterfall climbing structure comprising:

a steel support frame;

a climbing surface formed of a single laterally curved panel of fiberglass attached to said support frame;

a reservoir tank attached to a base of said fiberglass panel for collecting water;

a pump positioned within said reservoir for re-circulating water;

a conduit operating with said pump and having a first end and a second end for directing pumped water to the second end of the conduit, the first end of the conduit being attached to the reservoir tank;

a dispensing tank located at top of said fiberglass panel whereupon said conduit directs water upwardly and out said second end to allow the water to overflow dispensing tank and cascade outward to be collected in reservoir tank, and a plurality of davits affixed adjacent the top of said panel to facilitate attachment of climber support devices.

2. The structure of claim 1 wherein said fiberglass panel is created from a mold that is carved into a series of descending depressions and ledges to create a simulated waterfall formation.

3. The structure of claim 1 wherein said fiberglass panel is permanently attached to said support frame.

4. The structure of claim 1 wherein a plurality of climbing holds is attached to said fiberglass panel.

5. The structure of claim 4 wherein said climbing holds are distributed across the climbing surface, the holds defining at least three axial climbing routes, the routes sufficiently separated circumferentially along the lateral curve of the single panel of fiberglass so that the three climbers can climb simultaneously.

6. The structure of claim 1 wherein said reservoir contains a quick-connect coupling for providing water to a flexible first end of the conduit, allowing water to flow from the reservoir and upwardly through the conduit and out of the second end into the dispensing tank.

7. The structure of claim 1 wherein said first end of conduit means is attached to an outflow tube of the reservoir with a quick connect coupling in pumping cooperation with the water in the water.

8. The structure of claim 1 wherein an outflow tube of the pump is coupled to a wall of said reservoir to facilitate the circulation of water upwardly from the reservoir through the conduit to the dispensing tank.

9. The structure of claim 1 wherein said dispensing tank includes an upwardly open ledge member with a contoured undulating upper surface for directing water in a generally parallel manner from said dispensing tank and down the climbing surface into the reservoir.

10. The structure of claim 1 wherein said reservoir comprises a perforated I-beam for support located inside at base of the reservoir.

11. The structure of claim 10 wherein said reservoir further comprises a grating that covers the entire top surface area of the reservoir and is centrally supported by said I-beam.

12. The structure of claim 11 wherein said reservoir further comprises a water flow regulator having adjustable flow control means to increase or reduce the water flow of the waterfall.

13. The structure of claim 12 additionally comprising a low water indicator located in said reservoir tank and a means of controlling pump damage due to low water levels.

14. The structure of claim 13 further comprising a misting system including a plurality of tubing and nozzles wherein said tubing conveys water from a water source and said nozzles render the water into a mist.

15. The structure of claim 14 wherein said misting system operates cooperatively with the circulating pump.

16. The structure of claim 14 wherein said nozzles are located on radially outwardly oriented climbing surface of the fiberglass panel.

17. An artificial waterfall structure comprising;

a steel support frame;

a climbing surface formed of a single laterally curved panel of fiberglass;

a reservoir tank attached to the base of said fiberglass panel for collecting water;

a pump positioned within said reservoir for re-circulating water;

a conduit operating with said pump and having a first end and a second end for directing the pumped water to the second end of the conduit, the first end of the conduit being attached to the reservoir tank; and a dispensing tank located at top of said fiberglass panel whereupon said conduit directs water upwardly and out said second end to allow the water to overflow and cascade outward to be collected in reservoir tank, a plurality of davits affixed adjacent the top of said panel to facilitate the attachment of climber support devices;

a plurality of climbing holds distributed across the climbing surface, the holds defining at least three axial climbing routes, the routes sufficiently separated circumferentially along the lateral curve of the structure so that three climbers can climb simultaneously;

a perforated I-beam for support located inside the reservoir tank at a base of said reservoir;

a grating that covers entire top surface area of said reservoir and is centrally supported by said I-beam;

a water flow regulator having adjustable flow control means to increase or reduce the water flow of the waterfall;

a low water indicator located in said reservoir tank and means of controlling pump damage due to low water levels; and a misting system including a plurality of tubing and nozzles wherein said tubing conveys water from a water source and said nozzles render the water into a mist.

* * * * *